US008325107B2

(12) United States Patent
Christison et al.

(10) Patent No.: US 8,325,107 B2
(45) Date of Patent: Dec. 4, 2012

(54) WIRELESS MONITOR PROXY

(75) Inventors: Gregory L. Christison, McKinney, TX (US); Brian R. Doherty, Allen, TX (US); John C. Sarallo, Frisco, TX (US); Sidney B. Schrum, Jr., Allen, TX (US)

(73) Assignee: QUALCOMM Incorporated, San Diego, CA (US)

( * ) Notice: Subject to any disclaimer, the term of this patent is extended or adjusted under 35 U.S.C. 154(b) by 786 days.

(21) Appl. No.: 11/351,747

(22) Filed: Feb. 10, 2006

(65) Prior Publication Data

US 2007/0188481 A1 Aug. 16, 2007

(51) Int. Cl.
*G09G 5/00* (2006.01)

(52) U.S. Cl. ..... 345/2.3

(58) Field of Classification Search ..... 345/2.3, 345/204, 520; 348/730
See application file for complete search history.

(56) References Cited

U.S. PATENT DOCUMENTS

| | | | | |
|---|---|---|---|---|
| 5,764,547 | A | 6/1998 | Bilich et al. | |
| 2003/0025648 | A1 | 2/2003 | Glen et al. | |
| 2003/0027517 | A1 | 2/2003 | Callway et al. | |
| 2003/0103570 | A1 | 6/2003 | Du Val | |
| 2003/0234776 | A1 * | 12/2003 | Konishi | 345/204 |
| 2005/0212965 | A1 | 9/2005 | Stone et al. | |
| 2006/0028399 | A1 * | 2/2006 | Glen et al. | 345/2.3 |
| 2006/0092959 | A1 | 5/2006 | Unger | |
| 2006/0095638 | A1 * | 5/2006 | Unger | 710/310 |
| 2006/0209745 | A1 | 9/2006 | MacMullan et al. | |
| 2006/0209892 | A1 | 9/2006 | MacMullan et al. | |
| 2007/0076006 | A1 * | 4/2007 | Knepper et al. | 345/520 |

OTHER PUBLICATIONS

International Search Report from PCT/US2007/061924 dated Oct. 11, 2007.

Written Opinion—PCT/US07/061924, International Search Authority—European Patent Office, Oct. 11, 2007.

International Preliminary Report on Patentability—PCT/US07/061924, The International Bureau of WIPO—Geneva, Switzerland, Aug. 12, 2008.

* cited by examiner

*Primary Examiner* — Yong H Sim

(74) *Attorney, Agent, or Firm* — Nicholas J. Pauley; Peter Michael Kamarchik; Jonathan T. Velasco

(57) ABSTRACT

The present invention provides a method and apparatus for optimizing the transmission of video configuration data in a system comprising a host computer and a display monitor. The invention comprises a wireless video source adapter connected to the host computer and a wireless video sink adapter connected to the monitor. Upon system startup, the video sink adapter acquires EDID information from the monitor and transmits it to the video source adapter, which does not activate its connection and indicate its presence to the host computer until after receiving the EDID information. The video source adapter then supplies the EDID information to the host computer in response to EDID requests from the computer. In this manner, the video source adapter acts as a virtual proxy for the display monitor from the point of the view of the host computer. The host computer then uses the EDID information to configure its video signal to match the parameters of the display monitor.

11 Claims, 2 Drawing Sheets

WIRELESS MONITOR PROXY

TECHNICAL FIELD

The present invention relates generally to wireless communication systems. Specifically, the present invention relates to the wireless transmission of video configuration data.

BACKGROUND OF THE INVENTION

Display devices that conform to the Video Electronics Standard Association (VESA) standard contain a parameter block (known as the Extended Display Identification Data, or EDID) that specifies the various resolutions and timing modes that the display supports. This parameter block is read via an Inter-Integrated Circuit ($I^2C$) connection between the video card and the monitor using a protocol known as the Data Display Channel (DDC).

FIG. 1 illustrates a typical computer monitor system in accordance with the prior art. The system comprises a computer 101 and display monitor 102. The computer 101 may be a desktop or notebook device, as well as any computing device that is capable of sending video data to an external display device. The computer 101 and display monitor 102 are connected by a wired link that includes a bidirectional $I^2C$ connection 110 and a unidirectional video connection 120.

Before sending video data to the display monitor, the computer needs to know the display's parameters contained in the EDID. In a typical VESA system, such as depicted in FIG. 1, the 2-wire $I^2C$ connection on the cable (be it VGA, DVI, etc.) is used to communicate EDID information. The host computer 101 acts as the $I^2C$ master, requesting blocks of the EDID from the monitor 102, which acts as the slave. The computer 101 acquires the needed video parameters by sending an EDID request 130 to the display monitor 102, which in turn sends the EDID information 140 to the computer.

With the introduction of wireless video transmission, the wired connection between the computer and the display is replaced by wireless adapters. In such a configuration, it is important that any wireless video system pass the EDID information about the target monitor to the host driving the wireless video source adapter on the computer. This allows the host to fine tune the video card's signal (which is duplicated on a wireless video sink adapter at the monitor) to match the idiosyncrasies of the target monitor. Further complicating the problem is the fact that most operating systems, and in particular Windows, do not provide any way to inject monitor information into the system other than the standard method of fetching it directly from the monitor via $I^2C$.

Therefore, a need exists for efficiently obtaining display monitor EDID information in a wireless computer video system.

SUMMARY OF THE INVENTION

The present invention provides a method and apparatus for optimizing the transmission of video configuration data in a system comprising a host computer and a display monitor. The invention comprises a wireless video source adapter connected to the host computer and a wireless video sink adapter connected to the monitor. Upon system startup, the video sink adapter acquires EDID information from the monitor and transmits it to the video source adapter, which does not activate its connection and indicate its presence to the host computer until after receiving the EDID information. The video source adapter then supplies the EDID information to the host computer in response to EDID requests from the computer. In this manner, the video source adapter acts as a virtual proxy for the display monitor from the point of the view of the host computer. The host computer then uses the EDID information to configure its video signal to match the parameters of the display monitor.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
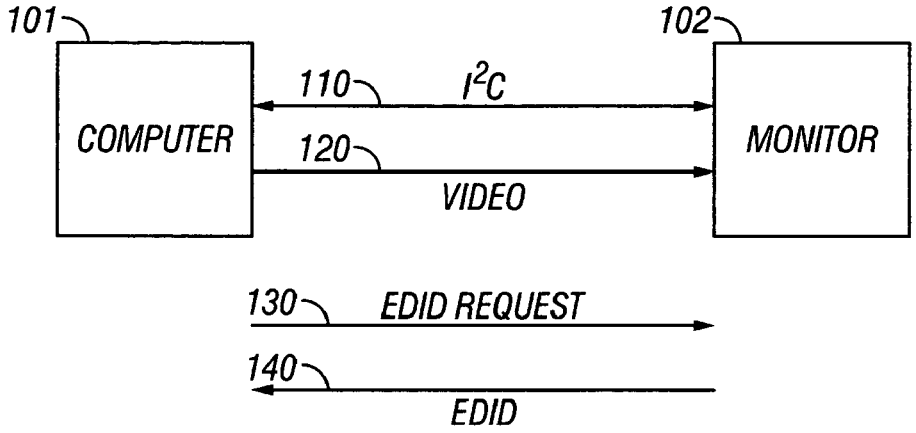
FIG. 1 (Prior Art)
FIG. 1 illustrates a typical computer monitor system in accordance with the prior art.
Figure 2:
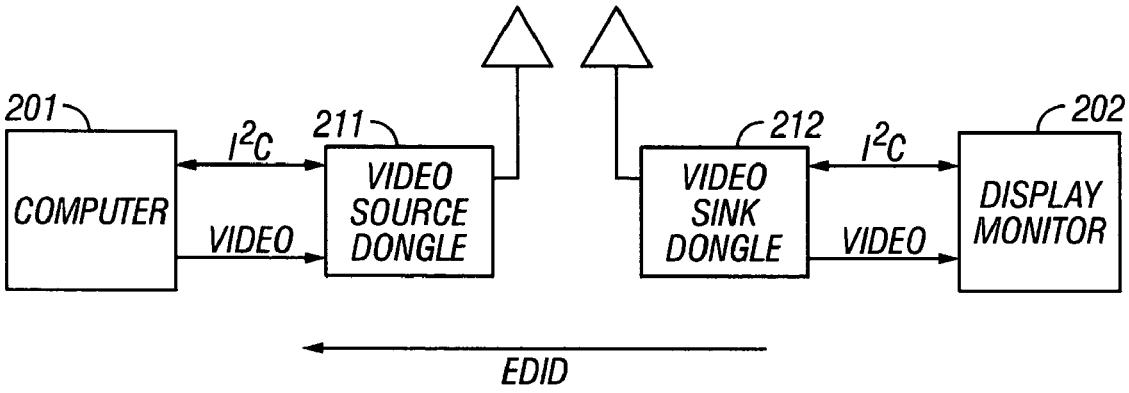
FIG. 2 is a block diagram depicting the components of a wireless video system in accordance with a preferred embodiment of the present invention.

FIG. 2 is a block diagram depicting the components of a wireless video system in accordance with a preferred embodiment of the present invention. The system comprises a computer 201 and display monitor 202. The computer 201 may be a desktop or notebook system, as well as any computing system that is capable of sending video data to an external display device. Unlike prior art systems, the present invention has a wireless connection between the computer and monitor. This wireless connection is facilitated by two adapters 211, 212.

In the present invention the wired $I^2C$ and video connections are between the computer 201 and its video source adapter 211 and between the display monitor 202 and its video sink adapter 212, as illustrated in FIG. 2. The computer 201 is configured to be a master and the video source adapter 211 is the slave. The video sink adapter 212 is also configured as a master with the display monitor 202 as the slave.

With the present invention the video sink adapter connected to the monitor imitates the host computer. Similarly, the video source adapter connected to the computer imitates the monitor. In this way, both the computer and monitor perceive a direct wired connection between each other where in fact none exists.

Figure 3:
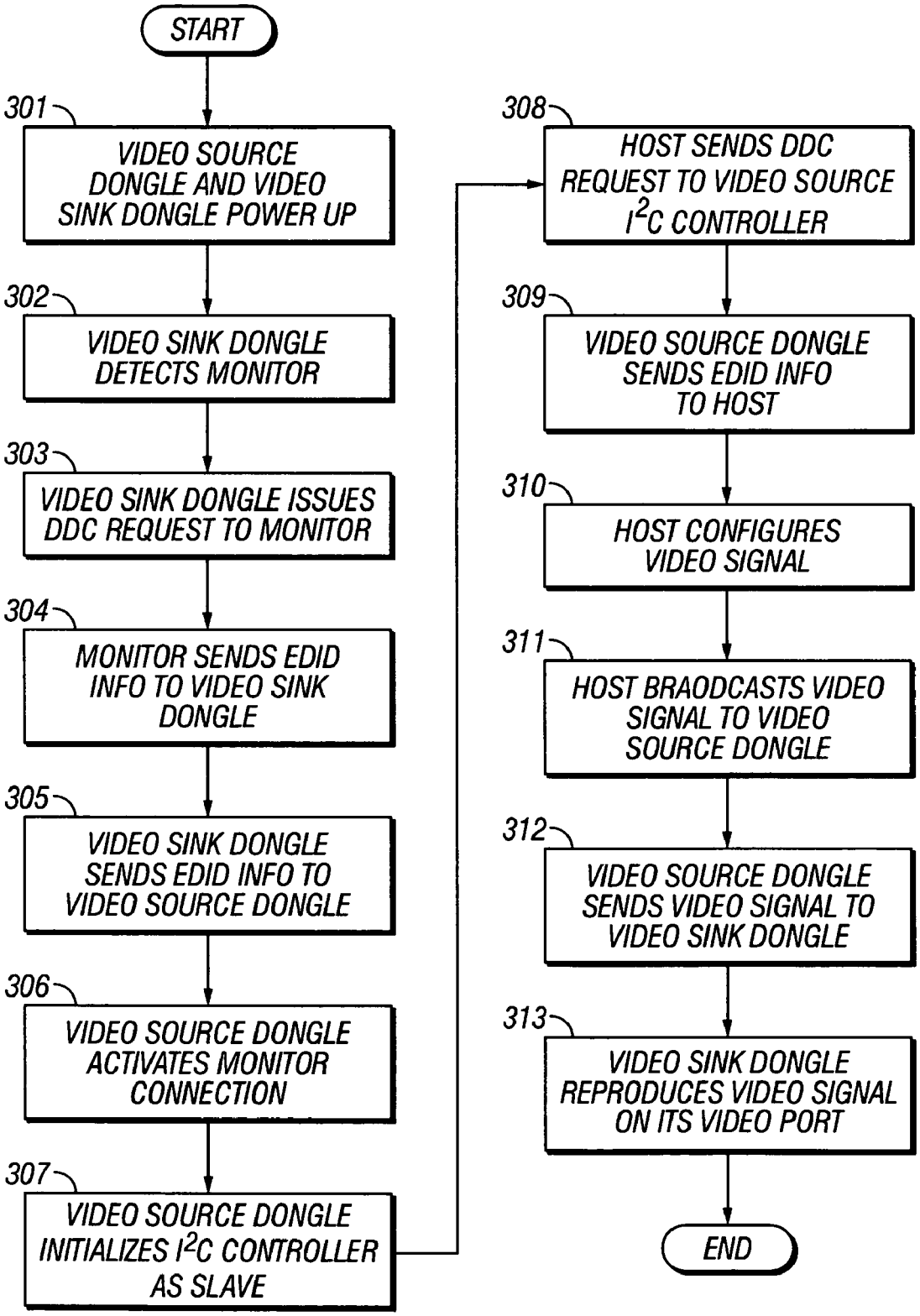
FIG. 3 illustrates the process of imitating the host and monitor in accordance with a preferred embodiment of the present invention.

FIG. 3 illustrates the process of imitating the host and monitor in accordance with a preferred embodiment of the present invention. To obtain EDID information from the monitor in real time, the computer would have to send a DDC request to the video source adapter, which in turn would transmit the request to the video sink adapter. The video adapter would then submit the request to the monitor. The EDID information provided by the monitor would follow the same route back to the host computer. The problem with this approach is the lag time involved.

To avoid this problem, the process of the present invention allows the video source adapter to acquire all of the EDID information from the monitor and store it before power up, allowing the video source adapter to act as a proxy for the monitor.

The process begins when the video source adapter and video sink adapter power up (step 301) and the video sink adapter detects an attached monitor (step 302).

The video sink adapter uses its $I^2C$ controller, configured to be a master, to issue DDC requests to the monitor to read its EDID (step 303). The monitor sends the EDID information to the video sink adapter (step 304), and the video sink adapter sends the EDID to the video source adapter as part of the wireless digital video (WiDV) startup process (step 305).

When the video source adapter starts up, it initially pretends to be unplugged from the computer from the point of view of the VGA, DVI, etc. After the video source has received the EDID information from the video sink adapter it activates its monitor connection and indicates its presence to the host (step 306) and initializes its $I^2C$ controller in slave mode (step 307). The EDID information may be stored in the connection driver of the video source adapter (e.g., USB or IEEE 1394 driver).

When host computer sends the DDC requests to the video source $I^2C$ controller (step 308), the video source adapter responds using the real monitor's EDID information, thus pretending that it is in fact the monitor (step 309).

The host computer uses the EDID information to configure its video signal (step 310) and start broadcasting it to the video source adapter (step 311). The video source adapter then relays the video signal via WiDV to the video sink (step 312), which reproduces the video signal on its video port, thus driving the video image to the monitor (step 313).

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A method for initiating and optimizing the transmission of wireless video configuration data in a system comprising a display monitor connected to a first wireless adapter and a host computer connected by a wired connection to a second wireless adapter external to the host computer, the method comprising the steps of:

(a) the second wireless adapter in response to initiation of a power up process pretending to be unplugged from the host computer;

(b) the first wireless adapter in response to said initiation of said power up process detecting the display monitor and initiating a request from the first wireless adapter to the display monitor for EDID information as part of said startup process;

(c) sending said EDID information from the display monitor to the first wireless adapter in response to said EDID request initiated by the first wireless adapter;

(d) transmitting said EDID information over a wireless link from the first wireless adapter to the second wireless adapter;

(e) the second wireless adapter ceasing to pretend to be unplugged from the host computer, initializing a connection controller of the second wireless adapter and activating a connection between the second wireless adapter and the host computer after said EDID information is received by the second wireless adapter, wherein data is not transmitted from the second wireless adapter over any wired interface until after the connection is activated; and (f) sending said EDID information from the second wireless adapter to the host computer after said initializing and said activating in response to an EDID request from the host computer, wherein the second wireless adapter acts as a proxy for the display monitor from the point of view of the host computer, (g) wherein the second wireless adapter initiates the overall process of routing said EDID information from the display monitor through said second and first wireless adapters to the host computer as part of said start up process.

2. The method according to claim 1, wherein the first wireless adapter is configured as a master of the display monitor.

3. The method according to claim 1, wherein the host computer is configured as a master of the second wireless adapter.

4. The method according to claim 1, wherein the second wireless adapter stores the EDID information in a driver controlling the connection between the second wireless adapter and the host computer.

5. The method of claim 1, wherein said connection controller comprises an $I^2C$ controller, and wherein said wired connection comprises a wired $I^2C$ connection.

6. The method of claim 5, wherein said initializing comprises initializing said $I^2C$ controller in slave mode.

7. An apparatus for initiating and optimizing the transmission of wireless video configuration data in a system comprising a host computer and a display monitor, the apparatus comprising:

a first wireless adapter connected to the display monitor, wherein the first wireless adapter detects the display monitor upon power up, and wherein the display monitor sends EDID information to the first wireless adapter in response to an EDID request initiated by the first wireless adapter as part of said power up process; and a second wireless adapter external to and connected to the host computer by a wired connection, the second wireless adapter comprising a connection controller, wherein the second wireless adapter pretends to be unplugged from the host computer in response to the initiation of said power up process and upon receiving said EDID information from the first wireless adapter via wireless transmission, the second wireless adapter ceases to pretend to be unplugged from the host computer, initializes said connection controller and activates a connection with the host computer after receiving said EDID information, wherein data is not transmitted from the second wireless adapter over any wired interface until after the connection is activated, and wherein the second wireless adapter sends said EDID information to the host computer after said initialization and said activation in response to an EDID request from the host computer, wherein the second wireless adapter acts as a proxy for the display monitor from the point of view of the host computer, wherein the second wireless adapter is configured to initiate the overall process of routing said EDID information from the display monitor through said second and first wireless adapters to the host computer as part of said start up process.

8. The apparatus according to claim 7, wherein the first wireless adapter is configured as a master of the display monitor.

9. The apparatus according to claim 7, wherein the host computer is configured as a master of the second wireless adapter.

10. The apparatus according to claim 7, wherein the second wireless adapter stores the EDID information in a driver controlling the connection between the second wireless adapter and the host computer.

11. The apparatus of claim 7, wherein said connection controller comprises an $I^2C$ controller, wherein said wired connection comprises a wired $I^2C$ connection, and wherein the second wireless adapter initializes said $I^2C$ controller in slave mode.

* * * * *